United States Patent [19]

Roth

[11] Patent Number: 4,883,001

[45] Date of Patent: Nov. 28, 1989

[54] PICNIC TABLE COVER

[76] Inventor: Alfred C. Roth, 2388 Yost Blvd., Ann Arbor, Mich. 48154

[21] Appl. No.: 135,008

[22] Filed: Dec. 18, 1987

[51] Int. Cl.[4] ..... A47B 13/08

[52] U.S. Cl. ..... 108/90; 108/27

[58] Field of Search ..... 108/90, 97, 27, 118; 150/52 R, 52 F

[56] References Cited

U.S. PATENT DOCUMENTS

| | | | |
|---|---|---|---|
| 2,556,943 | 6/1951 | Reisman | 108/90 |
| 2,861,386 | 11/1958 | Paulsen et al. | 108/90 X |
| 3,339,504 | 9/1967 | Schreyer | 108/90 X |
| 3,389,520 | 6/1968 | Gray et al. | 108/90 X |
| 3,554,140 | 1/1971 | Homesberger | 108/90 |
| 4,616,434 | 10/1986 | Riba et al. | 108/90 X |
| 4,627,363 | 12/1986 | Jones | 108/90 |
| 4,705,084 | 11/1987 | Rodenbaugh et al. | 108/90 X |
| 4,708,183 | 11/1987 | Figueroa | 108/90 X |

FOREIGN PATENT DOCUMENTS

| | | | |
|---|---|---|---|
| 32881 | 11/1962 | Finland | 108/27 |
| 940286 | 12/1948 | France | 108/90 |

*Primary Examiner*—Kenneth J. Dorner
*Assistant Examiner*—José Chen
*Attorney, Agent, or Firm*—Charles W. Chandler

[57] ABSTRACT

A sheet plastic cover for a picnic table has a pair of channel-shaped side edges so that the cover can be slid onto the table and attached by an adhesive or nails to the table. The cover is useful for either protecting the table surface or changing the appearance of the table. A similar cover is mounted on the seat of the picnic table.

2 Claims, 2 Drawing Sheets

PICNIC TABLE COVER

BACKGROUND OF THE INVENTION

This invention is related to a rigid cover for the horizontal surfaces of a picnic table, and more particularly, to such a cover having channel-shaped sides which can be slid onto a picnic table to either protect or provide a different surface appearance.

Picnic tables are exposed to the weather. For that reason they frequently require an annual refinishing. The refinishing may include sanding the surface finish and then revarnishing the table surface for another season. This is a time-consuming and expensive process.

SUMMARY OF THE INVENTION

The broad purpose of the present invention is to provide a cover for a picnic table comprising a rigid plastic, metal or combination metal/plate sheet having channel-shaped sides so that the cover can be slid on to the table. The cover has a body with a width and a length accommodating the width and length of the picnic table top. The covers come in various standard lengths and widths.

A table having a length and width greater than that of the cover may have its side edges trimmed until the table top can be received in the cover. A spacer is provided for a table having a width narrower than that of the cover. The spacer is mounted along the side edge of the table within one or both of the channel-shaped sides. Either adhesive means or nails attach the cover to the table.

End caps are nailed over the cover to protect the end edges of the table.

Similar covers are provided for the table seats to either protect the wood surface or to change their appearance. The appearance change can be either to provide a different texture, a different color or the like. The covers can be removed or replaced by other suitable covers thereby eliminating the need for the annual refinishing of the wooden top and seats of conventional picnic tables. Fitting of the seat covers is similar to the fitting of the top cover.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
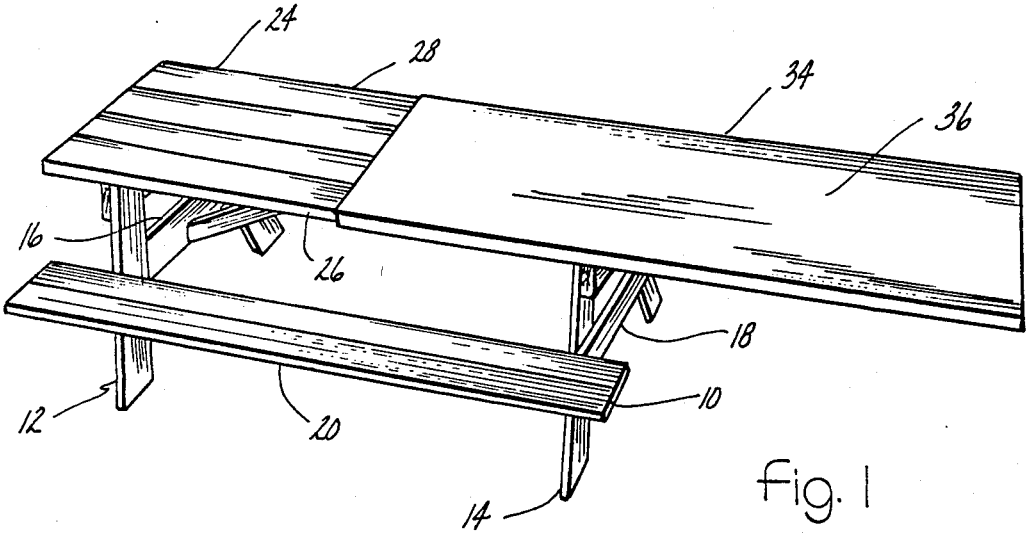
FIG. 1 shows a cover illustrating the invention partially slid on the top of conventional picnic table.

FIG. 1 illustrates a conventional wooden picnic table 10 having spaced leg means 12 and 14. A pair of horizontal supports 16 and 18 are attached to leg means 12 and 14, respectively. A pair of elongated wooden seat members 20 and 22 are mounted on the ends of supports 16 and 18. The seats have parallel side edges and parallel end edges.

A table top 24 having parallel side edges 26 and 28, and parallel end edges 30 and 32, is attached to the top of the leg means to form a horizontal table surface.

A plastic cover 34 is mounted on the table top. Cover 34 is preferably formed of a relatively thin, rigid plastic material having a planar midsection 36 with a length and width corresponding to table top 24. A metal sheet can also be used instead of plastic.

Figure 5:
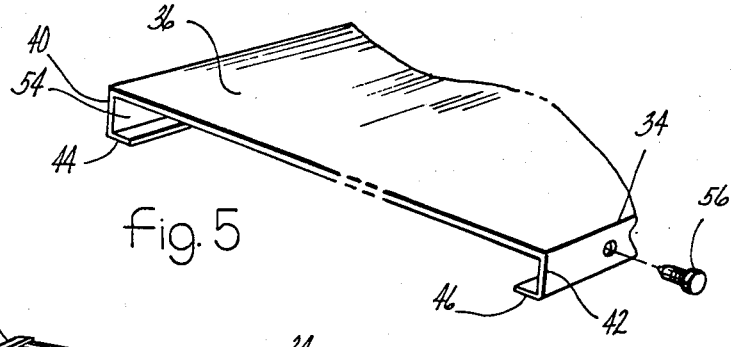
FIG. 5 is an enlarged fragmentary view of one end of the table top cover.

Referring to FIG. 5, the cover has a pair of sides 40 and 42 which depend downwardly from opposite sides of midsection 36. A pair of inwardly extending lips 44 and 46 are connected to the bottom of sides 40 and 42, parallel to midsection 36. The lips and sides form channel-shaped edges for receiving the side edges of the table top. Accordingly, the channels are slightly wider than the thickness of the table top.

Figure 2:
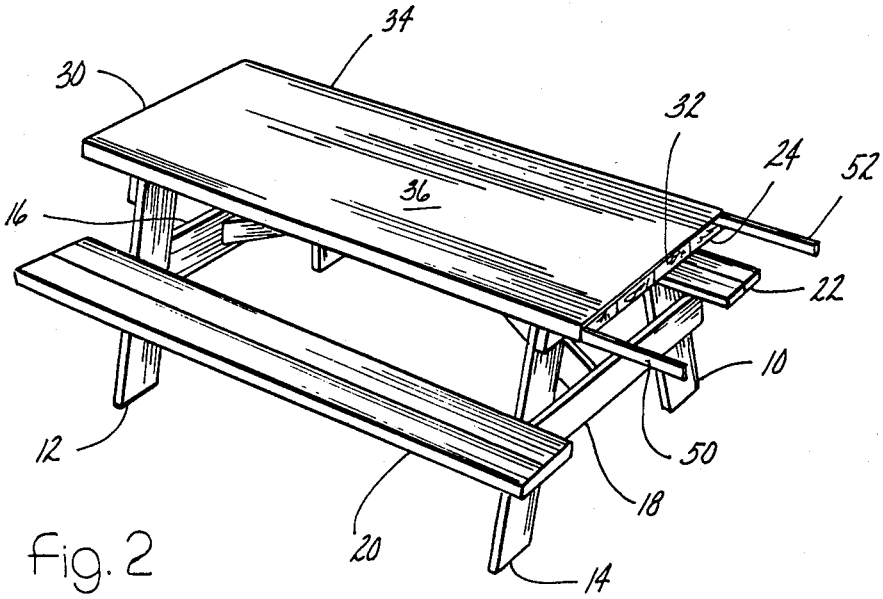
FIG. 2 is a view similar to FIG. 1 but with the table top fully inserted in the cover and a pair of side-edge spacers partially inserted.

The cover is preferably formed in standard widths so that if the table top is too wide for the cover, the table side edges can be trimmed to accommodate the width of the cover. On the other hand, if the width of the table top is too narrow for the cover, a pair of elongated, thin spacer members 50 and 52 are mounted between the side edges of the table and the inside of the channel-shaped edges of the cover, as best illustrated in Figure 2, so that the cover is securely mounted in place.

Referring to FIG. 5, a suitable adhesive 54 is disposed on either the inside of the cover or on the table top surface to fasten the cover to the table top. Alternatively, nail means can be employed such as at 56. The length of the cover is also relatively standard as are coventional picnic tables. However, if the cover is too long it can be trimmed to accommodate the length of the table top.

Figure 4:
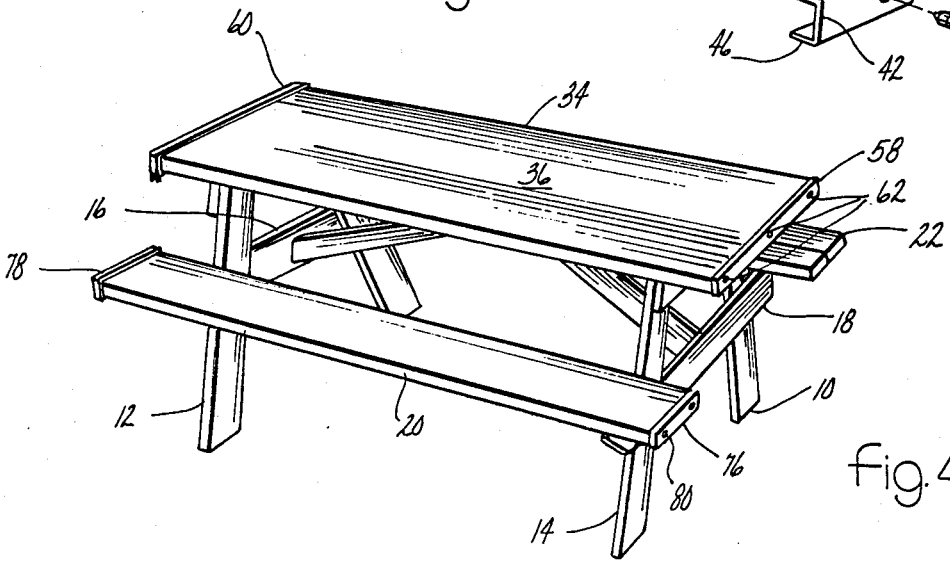
FIG. 4 is a view showing the table top and end caps fully mounted on the picnic table.

A pair of elongated end caps 58 and 60 are preferably attached by adhesive 54 and/or nail means 62 to cover the exposed ends of the table, as illustrated in FIG. 4.

As illustrated in FIG. 1, the cover is slid lengthwise on the table top and then fastened in position either by using an adhesive, or by nailing the cover in place.

Figure 6:
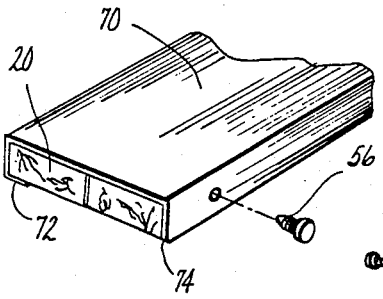
FIG. 6 is an enlarged fragmentary view of one end of one seat cover.
Figure 3:
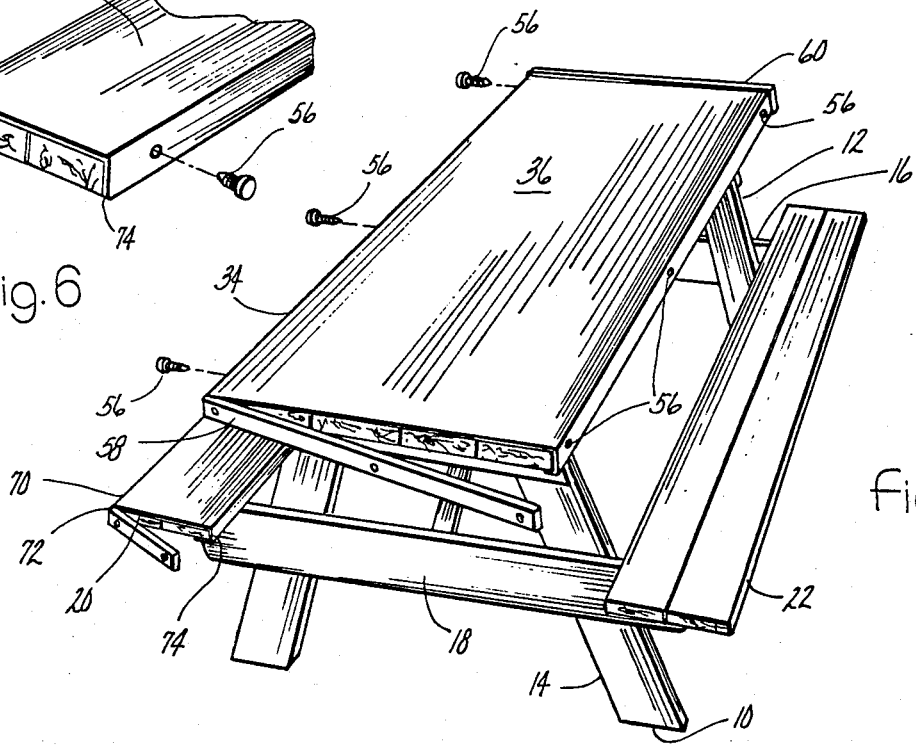
FIG. 3 is a view similar to FIG. 1 but showing the end caps partially mounted on the table top and one of the seats.

Referring to FIG. 6, a similarly-shaped but narrower and thinner cover 70 is mounted on seat 20. The seat cover has one channel-shaped side edge 72 and one vertical side-wall 74 for receiving the side edges of the seat. cover 70 may be fastened by adhesive 54 and/or nail means 56. A pair of rectangular end caps 76 and 78 are fastened by adhesive 54 and/or nail means 80 to the ends of the seat, as illustrated in FIG. 4.

The opposite seat can also be covered with a seat cover similar to seat cover 70.

Thus it is to be understood that I have described a set of covers for the table top and seats of a picnic table to either change the appearance of the picnic table or to protect the horizontal natural wooden components of a picnic table to prolong its life.

Having described my invention, I claim:

1. An outdoor picnic table comprising:

a plurality of elongated wooden planks arranged in edge-to-edge relationship to define a nominally flat, generally continuous top surface, parallel side edges, and transverse end edges;

protective cover means comprising a stiff, thin sheet of impervious plastic material having a face area commensurate with the area of said top surface, integral edge walls (40, 42) extending downwardly from opposite edges of said sheet for positionment in close proximity to edge areas of said top surface, and integral lip walls (44, 46) extending inwardly from said edge walls for positionment in close proximity to undersurface areas of said wooden planks at the parallel side edges;

said edge walls and lip walls being formed from the same plastic material as the stiff thin sheet, such that the cover means is a one-piece seamless structure;

said one-piece seamless structure having permanent bend lines where the edge walls are connected to the stiff sheet and lip walls, whereby the cover means can be slidably installed on the wooden planks to maintain a grip on said top surface in spite of wind forces tending to uncurl the lip walls from engagement with the undersurface areas of said planks;

two sealing caps dimensioned to correspond to the shape of the surface of the plank end edges, said sealing caps being applied against the plank end edges to seal against entry of rain into the planks;

said caps having sealed connections with the thin sheet to prevent wind from getting between the sheet and the top surface of said planks;

at least one elongated spacer member insertable between an inner face of an edge wall (40 or 42) and a side edge of the wooden planks, to enable the cover means to maintain a firm stable position on the top surface in spite of tolerance variations in plank width dimensions; and means for attaching the cover means and the end caps to the wooden planks in a permanently fixed position thereto.

2. A combination comprising:

a wooden plank structure having a nominally flat, generally continuous upper surface, parallel side edges and transverse end edges adapted to be supported in a horizontal position in an outdoor environment;

cover means comprising a thin, stiff plastic sheet having a width and length corresponding to the width and length of the plank structure, and positioned on the upper surface of the plank structure to protect said upper face from weather elements;

downwardly-depending side walls integral with said plastic sheet and positioned along side edge areas of the plank structure;

inwardly-extending lips integral with said side walls for positionment against undersurface areas of the plank structure;

said plastic sheet, depending side walls and inwardly-extending lips forming a one-piece seamless cover structure having a length substantially the same as that of the plank structure, whereby said seamless structure can be slidably installed on the plank structure by a longitudinal motion parallel to the inwardly extending lips;

plastic sealing end caps connected adjacent the surfaces of the end edges of the plank structure to seal against entry of rain or wind between the cover structure and the plank structure; and means for attaching the cover means and the end caps to the wooden lank structure to form a permanent cover thereto.

* * * * *